US005116048A

United States Patent [19]

Bilocerkowycz et al.

[11] Patent Number: 5,116,048

[45] Date of Patent: May 26, 1992

[54] GOLF GAME, APPARATUS AND METHOD THEREFOR

[75] Inventors: Robert J. Bilocerkowycz, Lake Barrington; Timothy S. Denison, Chicago, both of Ill.

[73] Assignee: Risky Business Enterprises, Inc., Farmington Hills, Mich.

[21] Appl. No.: 552,791

[22] Filed: Jul. 11, 1990

[51] Int. Cl.[5] ..... A63F 7/06

[52] U.S. Cl. ..... 273/87 B; 273/87.2; 273/22

[58] Field of Search ..... 273/87 B, 123 R, 176 R, 273/176 AB, 5 A, 59 R, 87.2, 14, 22, 328, 85 R, 85 A, 85 B, 85 F

[56] References Cited

U.S. PATENT DOCUMENTS

| | | | |
|---|---|---|---|
| 278,341 | 5/1883 | Kelly | 273/123 R |
| 433,624 | 8/1890 | Jacobs | 273/125 R |
| 513,876 | 1/1894 | Burt | 273/59 R |
| 736,938 | 8/1903 | Clark | 273/87 B |
| 1,311,671 | 7/1919 | Woods | 273/5 A |
| 2,809,040 | 10/1957 | Trovato | 273/123 R |
| 3,138,387 | 6/1964 | Michel et al. | 273/123 R |
| 3,578,321 | 5/1971 | Skully | 273/87 B |
| 3,647,212 | 3/1972 | Barlow et al. | 273/85 B |
| 4,114,876 | 10/1978 | Maruszak | 273/123 R |
| 4,136,871 | 1/1979 | Meyers et al. | 273/85 A |
| 4,875,680 | 10/1989 | Gross | 273/87 B |

*Primary Examiner*—William H. Grieb
*Assistant Examiner*—Steven B. Wong

[57] ABSTRACT

A game comprising:

a playing course including an elongated, preferably rectangular playing area arranged on particular given surface, including a marker for defining outer boundaries thereof;

a plurality of movable playing pieces placed into play relatively simultaneously, each playing piece adapted to be propelled about the playing course, by a club or stick, under control of a player of the game;

a plurality of receptacles positioned about the playing course, to provide a pocket, cup or hole for receiving various ones of the playing pieces when propelled therein by a player, the receptacles positioned in an orientation about the playing course in a manner resembling that of a billiard or pool table.

12 Claims, 2 Drawing Sheets

FIG. 1
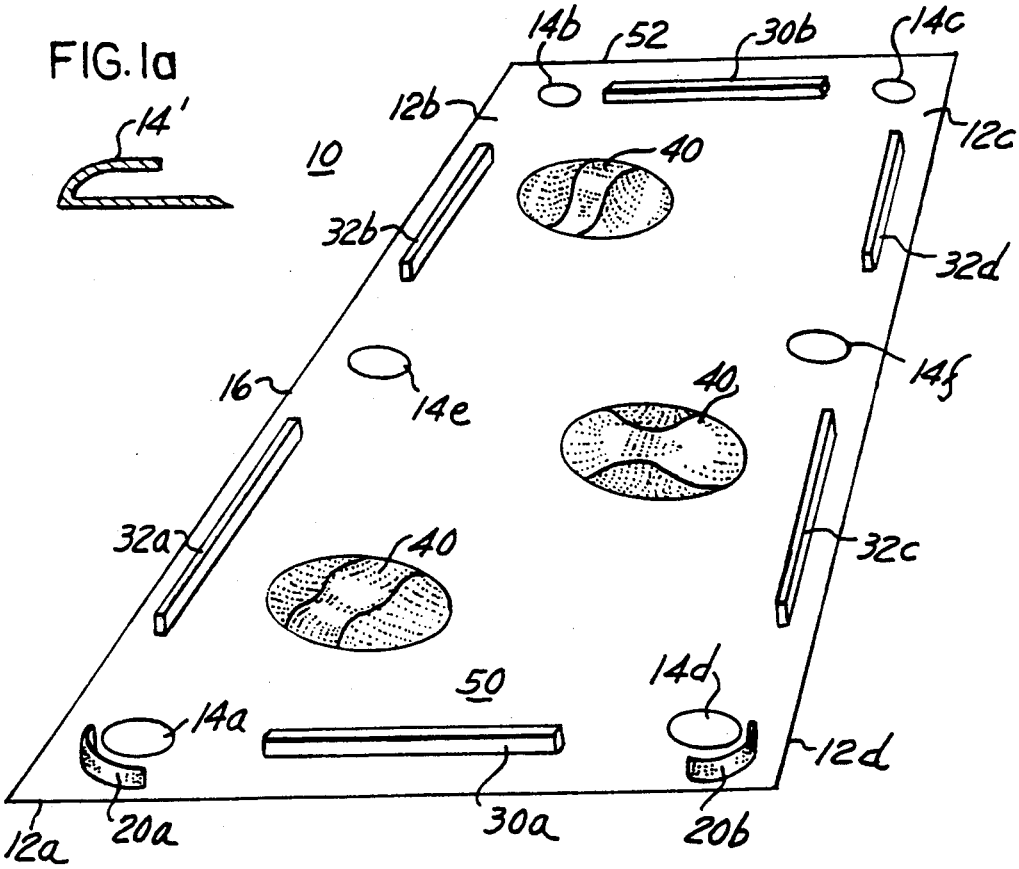
FIG. 1a
FIG. 5
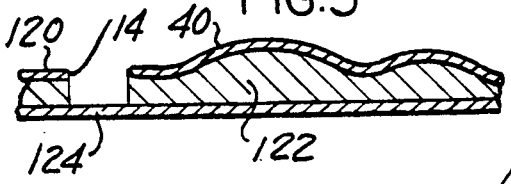
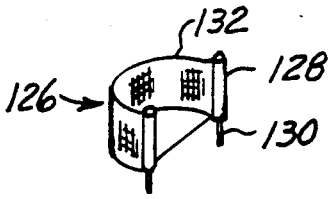
FIG. 6
FIG. 4
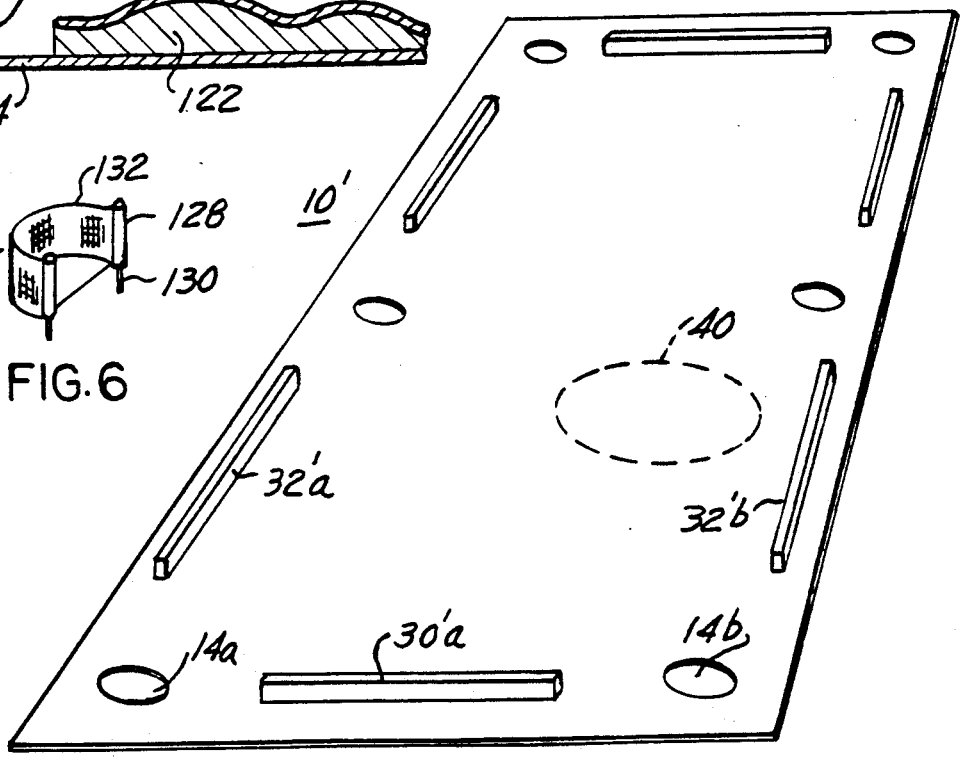

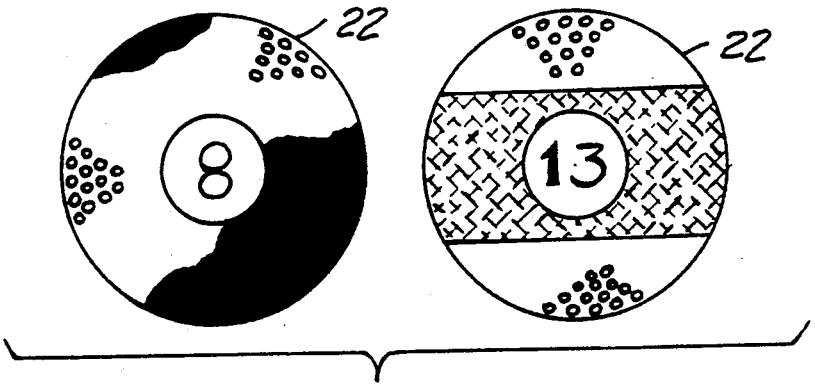
FIG. 2
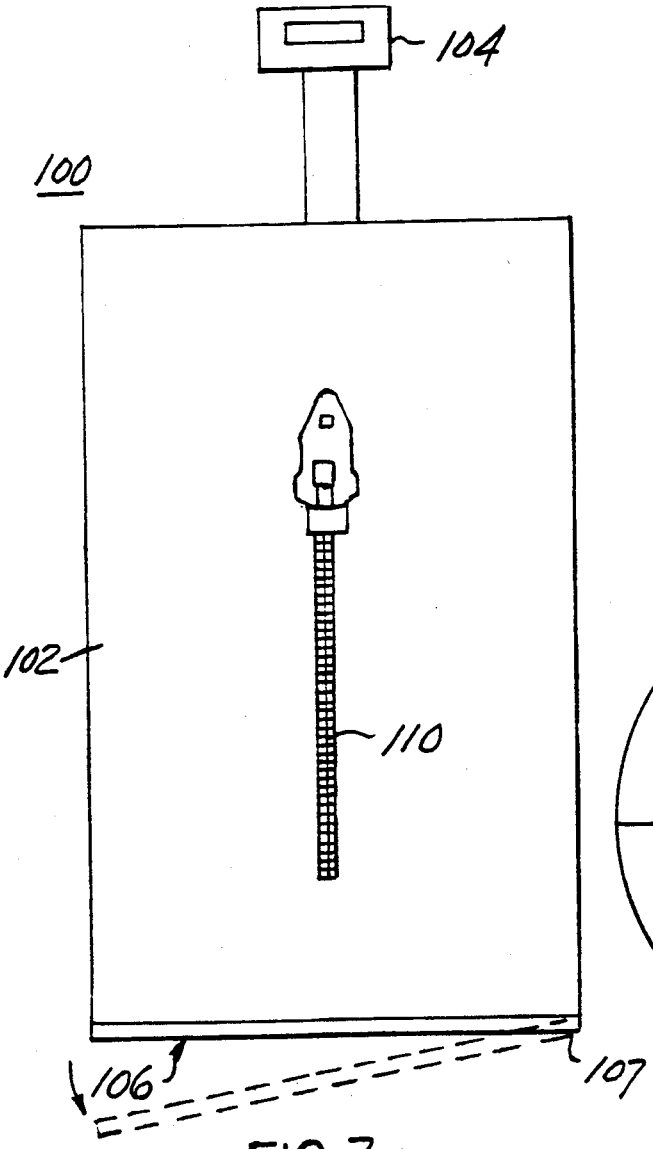
FIG. 3a
FIG. 3b
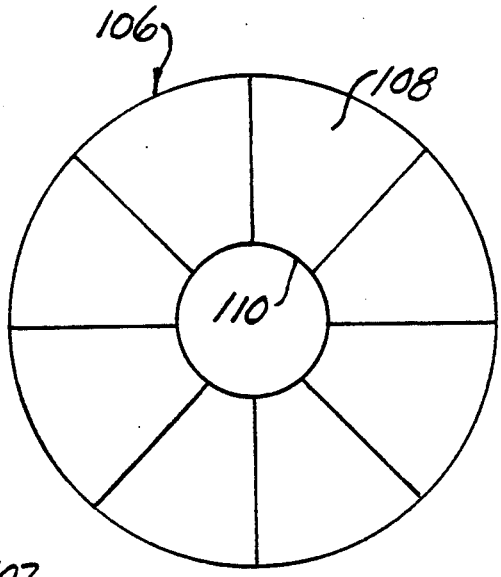

GOLF GAME, APPARATUS AND METHOD THEREFOR

BACKGROUND AND SUMMARY OF THE INVENTION

This invention relates to the recreational golf game and related apparatus.

Miniature indoor and outdoor golf courses of various sizes and types are well known in the art. These courses do not often represent a sufficient degree of challenge and versatility to a golf player whether experienced or not. The layout of these courses is relatively simplistic having a player follow a ball from one hole to another. Indoor versions of these golf-type games have also been proposed using a relatively small rectangular playing area such as a covered floor or pool table. In all such games and courses known to the applicant the game players use or follow a single ball about the playing surface.

The present invention provides a recreational golf game requiring competitive playing skills and one which incorporates the strategic skills used in playing pool or billiards.

Accordingly, the invention comprises: a game comprising: a playing course including an elongated, preferably rectangular playing area arranged on a particular given surface, including means for defining outer boundaries thereof; a plurality of movable playing pieces placed into play relatively simultaneously, each playing piece adapted to be propelled about the playing course, by means for propelling same, under control of a player or players of the game; a plurality of receptacles positioned about the playing course, to provide pocket means for receiving various ones of the playing pieces when propelled therein by a player of the game, the receptacles positioned in an orientation about the playing course in a manner resembling that of a billiard or pool table.

It is the object of the present invention to provide game and apparatus which is versatile enough to be played by golf players of varying levels of skill but one which requires substantially less real estate than a true golf course. A further object of the invention is to provide a skill game wherein a plurality of balls are initially and simultaneously placed in play.

Many other objects and purposes of the invention will be clear from the following detailed description of the drawings.

BRIEF DESCRIPTION OF THE DRAWINGS

In the drawings:

FIG. 1 illustrates a projected view of the playing surface.

FIG. 1*a* illustrates a variation of a cup.

FIG. 2 illustrates an apparatus for use within the playing surface.

FIGS. 3*a* and *b* illustrate a ball distribution device used in the present invention.

FIG. 4 illustrates an alternate embodiment of the invention suitable for indoor play.

FIG. 5 illustrates a cross-sectional view through a portion of FIG. 4.

FIG. 6 illustrates an alternate ball receptacle.

DETAILED DESCRIPTION OF THE DRAWINGS

FIG. 1 illustrates a playing course or surface 10 according to the present invention. In one embodiment of the invention, this playing course is laid out on the ground, grass or similar outdoor surface and has a general rectangular configuration. The size of the playing course, in this embodiment of the invention, may be in the vicinity of 20 feet wide by 50 feet long. A more challenging course can be achieved by utilizing a larger playing surface or field of approximately 28 feet by 60 feet long. It should be appreciated that a similar, though smaller, arrangement can be used indoors. Positioned proximate the four corners 12*a–d* of the playing course 10 are four receptacles such as holes or golf cups 14*a–d* recessed into the playing surface 10. Alternatively, a surface mounted receptacle such as a cup 14' (see FIG. 1*a*) or screen-like pocket may be laid upon the playing surface. Two additional holes or cups 14*e* and *f* are provided midway along the length of the playing course. The playing course perimeter or outer boundary 16 may be identified with a visually distinctive marking or coloring 16. Positioned outboard of the four corner cups (or pockets) 14*a–c* are optional cup guards 20*a–d* (only 20*a* and *b* are shown) which, if used, are used to deflect the playing pieces such as ball 22 onto the course or into one of the cups 14. In FIG. 1 these cup guards are arcuately shaped, however, other contours such as flat, conical, triangular are within the scope of the present invention. Positioned between cups 14*a* and d and 14*b* and *c* are first and second bumper strips or rails 30*a* and *b*. Positioned between each corner cup and the central cups 14*e* or 14*f* are an additional plurality of bumper rails 32*a* and *b* and 32*c* and *d* respectively. Depending upon the size and weight of these rails they may be manufactured as one integral unit or alternatively fabricated in parts laid adjacent to one another to achieve the overall desired length of these rails. In the preferred embodiment of the invention it is contemplated that the rails or strips will extend approximately 60% of the distance between corresponding adjacent cups 14*a–f*. The rails may be fabricated of non elastic, slightly elastic or resilient members to provide a rebound surface and partial boundary for the playing pieces 22.

As it is contemplated, a typical playing surface 10 will be relatively flat. The playing surface 10 may incorporate a variety fixed of movable obstructions or course changers 40 which may be permanently placed or movably positioned on the playing surface 10 prior to initiating a play to uniquely vary the topography of the playing surface on a periodic basis as well as to further challenge the skill and depth of the players. These course changers may comprise obstructions of various shape, texture and design. These course changers 40 may impede or at least change the forward motion of the propelled ball 22. As can be appreciated these changers 40 may a curved, elevated or otherwise shaped permitting the ball to roll thereover and perhaps as it does to divert the ball from its normal trajectory. The top of the course changer may be smooth, rough, curved and have troughs and high spots or other similar features which when contacted by the ball alters its trajectory.

In the preferred embodiment of the invention the game will be played with a standard golf putter such as one that conforms to USGA Rule No. 4. Similarly the cups 14 would measure about 4½ inches in diameter in conformance with standard dimensions. As can be seen from FIG. 1, the layout of the course 10 resembles that of a pool table comprising the six cups 14. The method of play may be patterned after variations of known pool games. To achieve the flavor of playing pool on a physical golf course, the balls 22 used therein are a specific design, as described below. Additionally, the game may utilize a plurality, preferably at least 15 golf balls. As an example if 15 balls are used they are alternately numbered from 1 through 15 having sets of striped and solid fascia resembling the 15 balls used in a standard pool game. One such striped ball 22 having an orange stripe is shown in FIG. 2. In the indoor version of the game the balls would be fabricated of material suitable for indoor use but having the same design. A lesser or equal number of balls 22 may be used indoors.

A typical method of playing the present invention on the above playing course would have the players putt from near one end such as location 50 to a designated position at the other end of the course. This designated position can be the opposite boundary 52 or alternatively the opposing bumper rails or strip such as 30*b*. The player whose ball comes closest to this designated position becomes the first player to control the playing surface 10.

Each of the plurality (15) of variously colored balls 22 are placed within a distribution device called a scatter shoot generally shown as 100, see FIGS. 3*a* and *b*. The balls 22 are placed into a housing 102 of the scatter shoot 100 and thereafter relatively simultaneously lossed about the playing field. In the preferred embodiment the scatter shoot includes a housing 102 made of canvass having a handle 104 extending therefrom. Positioned opposite the handle is an cover 106. This cover may be fully or partially removable to permit the distribution of the balls 22. As an example the cover 106 may be hinged at one end 108 and secured at another end by a Velcro strip. Alternatively the cover 106 may be constructed of overlapping segments 108 of a semi-stiff material such as rubber or plastic which extend inwardly to define an opening 110 having a diameter initially less than the diameter of a typical ball 22. During the scattering of the balls that is, as the scatter shoot is swung the balls therein are thrown outwardly against the segments 108 causing same to move outwardly thereby enlarging the size of the opening 110 to permit the balls to exit from the housing.

The housing may also include a zipper 112, opening or other means to permit the loading of the balls therein. Upon loading all of the balls into the scatter shoot 100 the cover 106 is opened, partially or fully, and the balls distributed about the playing surface. Depending upon the rules of the game, agreed upon by the players, the balls may simply be dropped vertically onto the playing surface or may be forcefully scattered thereabout such as by swinging the scatter shoot 100 as the balls exit therefrom. The rules of the game may include the following initial procedure: If as an example during the initial scattering of the balls more than a designated number of balls (such as three) are scattered or stop outside the boundary of the playing course 10, the player who scattered the balls may forfeit his turn and his opponent continues to play. If more than a designated number of balls leaves the playing course, the balls can then be reinserted within the scatter shoot 100 and again released on the playing field by the next player. Thereafter the player having control of the playing course attempts to sink as many balls into appropriate cups in conformance with the immediate rules of play of the game.

Following a successful scatter, breaking or distribution of the balls, the player having control of the course 10 attempts to sink a succession of different balls 22 within designated cups 14. This is accomplished by striking the intended ball with a standard golf putter (not shown) or similar implement. As a result of utilizing a course resembling that of a pool table and by utilizing a plurality of balls color coded similar to that found in the game of pool enhances the versatility of, number of variations and skill requirements of the present invention. Some of these game variations may include the following:

1. A pocket pool variation wherein the first person to sink any eight (8), or designated number, of balls wins the game. In this procedure, after the opening shot is made, the player having control of the field 10 designates the particular ball intended to be hit. In this version, it is not necessary to designate the particular cup in which the ball may be placed.

2. Another version of the game is called 15 ball. The winner of this version is that person who reaches a total of 61 points. It should be appreciated that all of the balls carry a numerical designation i.e. 1 to 15. The number of points received by a player corresponds to the numeral value of the ball entering a cup. For example, the 7th ball yields 7 points, etc. Similarly, in this version it is not necessary to designate this specific cup the ball must enter.

3. Another variation is called "Rotation". The first player reaching for example 61 points, or other amount, is designated the winner. In this variation, each of the balls must be holed in order i.e. ball number 1, 2, 3 etc. The number of points received by a player corresponds to the numerical value of the ball hit into the cup.

4. A fourth variation is entitled "8 Ball" named for its corresponding pool counterpart. In the present invention the 8 ball is black in color and is in actuality the 8th numbered ball of the 15 balls used in the game. A player must sink a specified set of seven (7) balls i.e. those with strips or those with solid colors and then the designated black or 8th ball before his opponents sinks the other corresponding set of balls and the black, 8th ball. As with pool, the player must call the hole in which the black or 8th ball must enter. If for some reason, the number 8 ball is holed prior to the holing of the other specified 7 balls, that particular player automatically loses.

FIGS. 4 and 5 illustrate an exemplary indoor playing surface 10' having the general shape of the course shown in FIG. 1. The playing surface may comprise a synthetic grass or carpet material 120 secured to a one piece or multi-piece foam backing 122 which in turn is attached to a backer board 124. Each hole 14 may be formed as a cut-out in the material 120 and foam 122. The foam 122 may be formed to provide a course changer(s) shown in phantom line in FIG. 4. The bumper strips 30', 32' may be permanently attached to the material 120, foam 122 or backer board 124 or removable. For storage the surface, foam and board may be hinged at one or more locations. The surface need not contain the holes 14. In this case surface mounted receptacles such as 14' shown in FIG. 1*a* may be used or the netting 126 shown in FIG. 6. The netting 126 may include a plurality of posts 128 having extending pins 130 for securement into the foam 122 and a net 132 attached to the posts. As can be appreciated the surface 10' can also be formed by using only the material 120 with surface mounted receptacles 14' and bumper strips 30, 32 which are placed about the material 120.

Many changes and modifications in the above described embodiment of the invention can, of course, be carried out without departing from the scope thereof. Accordingly, that scope is intended to be limited only by the scope of the appended claims.

We claim:

1. A golf related game or device comprising:

a playing course or playing surface arranged on particular given surface, including means for defining outer boundaries thereof;

a plurality of movable playing pieces placed into play relatively simultaneously, each playing piece adapted to be propelled about the playing course, by means for propelling same, under control of a player of the game;

propelling means for propelling the playing pieces into play onto the course relatively simultaneously from a distance about the playing surface;

a plurality of receptacles positioned about the playing course, to provide pocket means for receiving various ones of the playing pieces when propelled therein by a player.

2. The device as defined in claim 1 wherein each playing piece is a golf ball and each ball carries a different consecutive number.

3. The device as defined in claim 1 wherein each playing piece is a golf ball and further contains a fascia or surface design resembling that of a billiard or pool ball.

4. The device as defined in claim 3 wherein a set of the plurality of playing pieces are numbered and striped and wherein another set of the playing pieces are numbered and are primarily of differing solid color.

5. The device as defined in claim 3 wherein at least one of the playing pieces is numbered and generally colored black.

6. The device as defined in claim 1 wherein the propelling means includes first means, held by a game player over the surface of the course, for receiving and temporarily holding the plurality of playing pieces and including second means, responsive to a motion of the player of the game to permit the plurality of playing pieces to exit the first means and enter onto the playing course in a generally random pattern during initiation of the game by a game player.

7. The device as defined in claim 1 further including guide means freely standing and positioned about the playing course, outboard and partially surrounding each receptacle for deflecting a playing piece, upon impact therewith, about the playing course.

8. The device as defined in claim 7 wherein the guide means comprises an arcuately shape deflecting element.

9. The device as defined in claim 1 including course changer means for providing a relocatable obstruction about the playing course for changing the trajectory of a moving playing piece as its moves in contact therewith.

10. The device as defined in claim 1 wherein the playing surface includes a grassy area.

11. The device as defined in claim 1 wherein the dimension of the playing surface is between 20 feet by 50 feet and 28 feet by 60 feet.

12. A method of playing a golf related game comprising the steps of:

propelling, from a distance above a playing surface, in a relatively simultaneous manner a plurality of balls on the playing surface;

hitting each of the balls into ball receptacles in accordance with rules of play of the game.

* * * * *